US012663167B2

(12) United States Patent
Taras et al.

(10) Patent No.: US 12,663,167 B2
(45) Date of Patent: Jun. 23, 2026

(54) AIR MANAGEMENT SYSTEM FOR A HEATING, VENTILATION, AND AIR-CONDITIONING SYSTEM

(71) Applicant: Goodman Global Group, Inc., Waller, TX (US)

(72) Inventors: Michael F. Taras, The Woodlands, TX (US); Santosh Nerur, Waller, TX (US); Hussain A. Gulam, Waller, TX (US); Mark Daniels, Saint Cloud, MN (US)

(73) Assignee: Goodman Global Group, Inc., Waller, TX (US)

( * ) Notice: Subject to any disclaimer, the term of this patent is extended or adjusted under 35 U.S.C. 154(b) by 80 days.

(21) Appl. No.: 18/656,807

(22) Filed: May 7, 2024

(65) Prior Publication Data

US 2024/0288180 A1 Aug. 29, 2024

Related U.S. Application Data

(62) Division of application No. 17/445,008, filed on Aug. 13, 2021, now Pat. No. 12,281,804.

(51) Int. Cl.

| | |
|---|---|
| ***F24F 1/0022*** | (2019.01) |
| ***F24F 1/0033*** | (2019.01) |
| ***F24F 1/38*** | (2011.01) |
| ***F24F 11/77*** | (2018.01) |
| *F24F 110/10* | (2018.01) |

(52) U.S. Cl.
CPC ..... *F24F 1/0022* (2013.01); *F24F 1/0033* (2013.01); *F24F 1/38* (2013.01); *F24F 11/77* (2018.01); *F24F 2110/10* (2018.01)

(58) Field of Classification Search
CPC ..... F24F 1/0022; F24F 1/0033; F24F 1/38; F24F 11/77; F24F 2110/10
See application file for complete search history.

(56) References Cited

U.S. PATENT DOCUMENTS

2017/0023264 A1* 1/2017 Ha ..... F24F 11/46

FOREIGN PATENT DOCUMENTS

EP 2993778 A1 * 3/2016 ..... H02P 5/74

* cited by examiner

*Primary Examiner* — Joseph F Trpisovsky

(57) ABSTRACT

A heating, ventilation, and air-conditioning ("HVAC") system. The HVAC system may include a refrigeration circuit and a blower system. The refrigeration circuit may include a compressor, an outdoor heat exchanger, an expansion device, and an indoor heat exchanger. The blower system may include a first direct-drive blower and a second direct-drive blower. The first direct-drive blower may flow air over the indoor heat exchanger. The second direct-drive blower may flow air over the indoor heat exchanger and the second direct-drive blower may operable and positionable relative to the indoor heat exchanger independently from the first direct-drive blower.

20 Claims, 5 Drawing Sheets

AIR MANAGEMENT SYSTEM FOR A HEATING, VENTILATION, AND AIR-CONDITIONING SYSTEM

BACKGROUND

This section is intended to provide relevant background information to facilitate a better understanding of the various aspects of the described embodiments. Accordingly, these statements are to be read in this light and not as admissions of prior art.

In general, heating, ventilation, and air-conditioning ("HVAC") systems circulate an indoor space's air over low-temperature (for cooling) or high-temperature (for heating) sources, thereby adjusting an indoor space's ambient air temperature. HVAC systems generate these low- and high-temperature sources by, among other techniques, taking advantage of a well-known physical principle: a fluid transitioning from gas to liquid releases heat, while a fluid transitioning from liquid to gas absorbs heat.

Within a typical HVAC system, a fluid refrigerant circulates through a closed loop of tubing that uses a compressor, which receives DC power from an inverter, and flow-control devices to manipulate the refrigerant's flow and pressure, causing the refrigerant to cycle between the liquid and gas phases. Generally, these phase transitions occur within the HVAC system heat exchangers, which are part of the closed loop and designed to transfer heat between the circulating refrigerant and flowing ambient air. As would be expected, the heat exchanger providing heating or cooling to the climate-controlled space or structure is described adjectivally as being "indoors," and the heat exchanger transferring heat with the surrounding outdoor environment is described as being "outdoors."

The refrigerant circulating between the indoor and outdoor heat exchangers, transitioning between phases along the way, absorbs heat from one location and releases it to the other. Those in the HVAC industry describe this cycle of absorbing and releasing heat as "pumping." To cool the climate-controlled indoor space, heat is "pumped" from the indoor side to the outdoor side, and the indoor space is heated by doing the opposite, pumping heat from the outdoors to the indoors.

Additionally, some split HVAC systems include two or more blowers positioned within an indoor unit that flow air over an indoor heat exchanger. However, such configurations are often driven by a single motor via a belt or a direct-drive motor rigidly attached to the shaft. Such a configuration can lead to increased power consumption due to friction losses, limited part-load operation options, space restriction and airflow blockage, and other factors. Additionally, the positioning requirements of such a configuration may result in non-uniform airflow over the indoor heat exchanger. Both of these issues may reduce the efficiency of the HVAC system. Furthermore, the motor size and power/torque requirements limit a number of available options as well as drive an unnecessary cost increases.

BRIEF DESCRIPTION OF THE DRAWINGS

Embodiments of the HVAC system are described with reference to the following figures. The same numbers are used throughout the figures to reference like features and components. The features depicted in the figures are not necessarily shown to scale. Certain features of the embodiments may be shown exaggerated in scale or in somewhat schematic form, and some details of elements may not be shown in the interest of clarity and conciseness.

DETAILED DESCRIPTION

The present disclosure describes an HVAC system having an air management system (also referred to as a blower system) including two direct-drive blowers. The direct-drive blowers are independently operable and optimally positioned relative to an indoor heat exchanger. Independently operating and positioning the blowers increases the efficiency of the HVAC system when compared to an HVAC system having blowers that are not independently operable and not optimally positioned relative to the indoor heat exchanger. Specifically, power consumption of the blowers can be reduced, as it is possible to operate only one blower when the load on the HVAC system is smaller and a belt-pulley interface is not necessary. Further, the blowers can be positioned to provide increased uniformity in airflow over the indoor heat exchanger and to eliminate the "cross-talk" between the blowers leading to the compromised airflow and increased power consumption.

Figure 1:
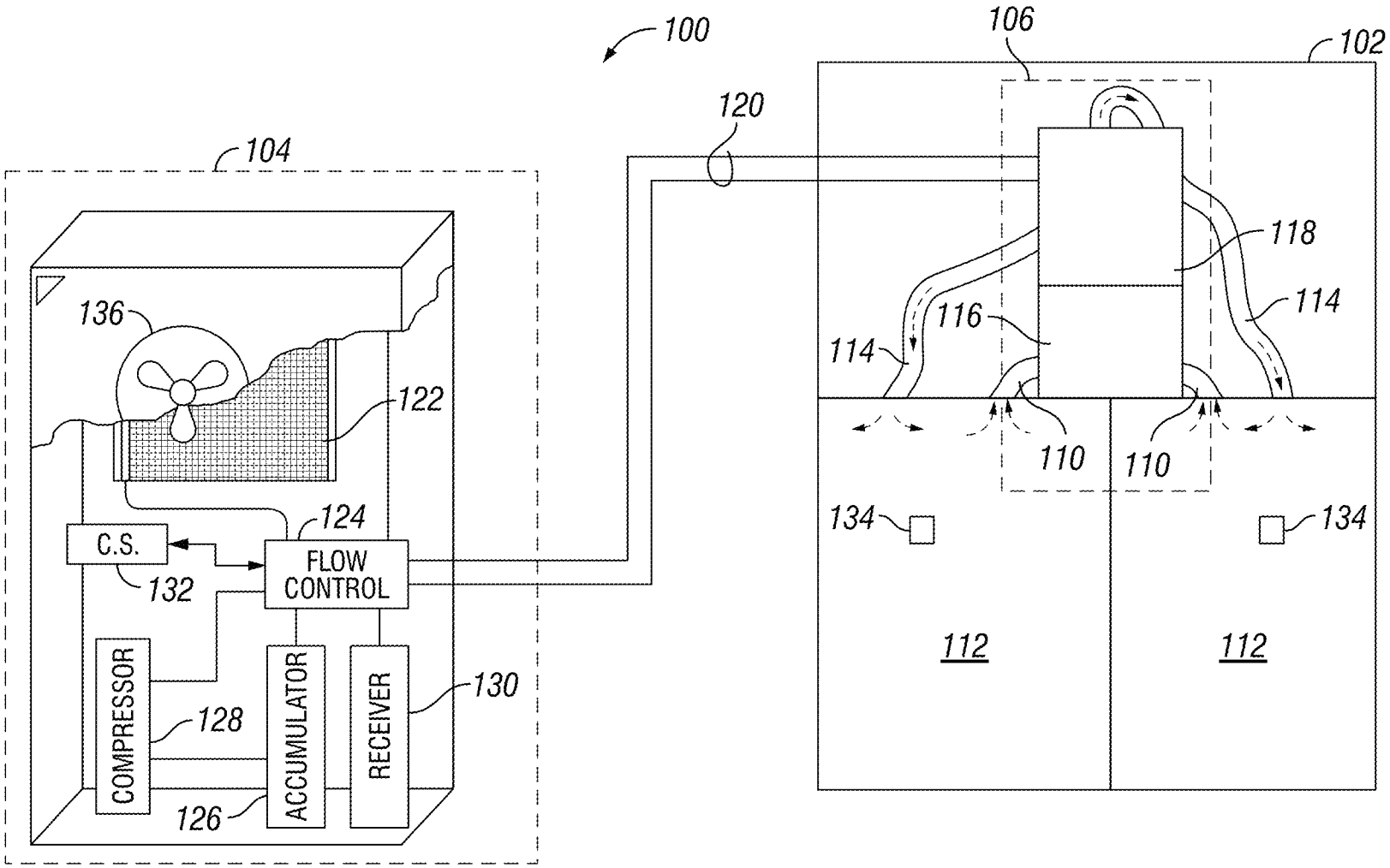
FIG. 1 is a schematic diagram of an HVAC system, according to one or more embodiments.

Turning now to the figures, FIG. 1 is a schematic diagram of an HVAC system 100 that provides heating and cooling for a structure 102. The concepts disclosed herein are applicable to numerous heating and cooling situations, which include residential, industrial, and commercial settings. The described HVAC system 100 is divided or split into two primary portions: (1) the outdoor unit 104, which mainly comprises components for transferring heat with the environment outside the structure 102; and (2) the indoor unit 106, which mainly comprises components for transferring heat with the air inside the structure 102. To heat or cool the illustrated structure 102, the indoor unit 106 draws ambient indoor air via return ducts 110, passes that air over one or more heating/cooling elements (i.e., sources of heating or cooling), and then routes that conditioned air, whether heated or cooled, back to the various climate-controlled spaces 112 through the supply ducts or ductworks 114—which may be relatively large conduits and may be rigid or flexible. A blower system 116 provides the motivational force to circulate the ambient air through the return ducts 110 and the supply ducts 114. Additionally, although a split system is shown in FIG. 1, the disclosed embodiments can be equally applied to the packaged or other types of the HVAC system configurations.

Within the indoor unit 106, the indoor heat exchanger 118 acts as a heating or cooling means that adds or removes heat from the structure, respectively, by facilitating the transfer of heat to or from refrigerant circulating within and between the indoor and outdoor units via refrigerant lines 120. Alternatively, the refrigerant could be circulated to only cool (i.e., extract heat from) the structure, with heating provided independently by another source, such as by a heating element, as described in more detail below. There may also be no heating of any kind. HVAC systems that use refrigerant to both heat and cool the structure 102 are often described as heat pumps, while HVAC systems that use refrigerant only for cooling are commonly described as air conditioners.

Whatever the state of the indoor heat exchanger 118 (i.e., absorbing or releasing heat), the outdoor heat exchanger 122 is in the opposite state. More specifically, if heating is desired, the indoor heat exchanger 118 acts as a condenser, aiding transition of the refrigerant from a high-pressure gas to a high-pressure liquid and releasing heat in the process. The outdoor heat exchanger 122 acts as an evaporator, aiding transition of the refrigerant from a low-pressure liquid to a low-pressure gas, thereby absorbing heat from the outdoor environment. To facilitate the exchange of heat between the ambient indoor air and the outdoor environment in the described HVAC system 100, the respective heat exchangers 118, 122 have tubing that winds or coils through heat-exchange surfaces, to increase the surface area of contact between the tubing and the surrounding air or environment.

If cooling is desired, the outdoor unit 104 has flow control devices 124 that includes valves (not shown) that can reverse the flow of the refrigerant, allowing the outdoor heat exchanger 122 to act as a condenser and allowing the indoor heat exchanger 118 to act as an evaporator. The flow control devices 124 may also act as an expansion device to reduce the pressure of the refrigerant flowing therethrough. In other embodiments, the expansion device may be a separate device located in either the outdoor unit 104 or the indoor unit 106.

Although not shown in FIG. 1, the indoor unit 106 may also include a heating element, such as an electric heating element or a gas furnace, operable when robust heating is desired. The heating element heats the ambient indoor air being pushed out of the blower system 116 and into the supply ducts 114. However, during conventional heating and cooling operations, air from the blower system 116 is routed over an indoor heat exchanger 118 and into the supply ducts 114. The blower system 116, the heating element, and the indoor heat exchanger 118 may be packaged as an integrated air handler unit, or those components may be separate. Further, the positions of the heating element, the indoor heat exchanger 118, and the blower system 116 can be reversed or rearranged as required for the specific HVAC application.

The illustrated outdoor unit 104 may also include an accumulator 126 that helps prevent liquid refrigerant from reaching the inlet of a compressor 128. The outdoor unit 104 may also include a receiver 130 that helps to maintain sufficient refrigerant charge distribution in the HVAC system 100. The size of these components is often defined by the anticipated or actual amount of refrigerant employed by the HVAC system 100.

The outdoor unit 104 also includes a compressor 128 that receives low-pressure gas refrigerant from either the indoor heat exchanger 118 if cooling is desired or from the outdoor heat exchanger 122 if heating is desired. The compressor 128 then compresses the gas refrigerant to a higher pressure based on a compressor volume ratio, namely the ratio of a discharge volume, the volume of gas outputted from the compressor 128 once compressed, to a suction volume, the volume of gas inputted into the compressor 128 before compression. In the illustrated embodiment, the compressor 128 is a multi-stage compressor that can transition between at least two volume ratios depending on whether heating or cooling is desired. In other embodiments, the HVAC system 100 may be configured to only cool or only heat, and the compressor 128 may be a single-stage compressor having only a single volume ratio or the compressor 128 may be a variable speed compressor.

A control system 132 controls the blower system 116 based on the required heating, cooling, and/or dehumidification that must be provided by the HVAC system 100, i.e., the demand on the HVAC system 100. The control system 132 may also control the blower system 116 based on settings input by a user via an input device, such as, but not limited to, thermostats 134 or a control panel of the HVAC system 100, and/or the operational status of the HVAC system 100. Although the control system is shown as a single component of the outdoor unit 104, this disclosure is not thereby limited. Alternatively, the control system 132 may be located within the climate-controlled area 112. Also alternatively, the control system 132 may be made up of multiple control systems or controllers, as described below with reference to FIG. 4, positioned at various points within the HVAC system and/or climate-controlled area 112 that are in electronic communication with each other.

The control system 132 may also adjust the air flow rate produced by a fan 136 that blows air across the outdoor heat exchanger 122 and the speed of the compressor 128. The control system 132 may further control the switching between compressor stages for multi-stage compressors. Although the thermostats 134 are shown as separate from the indoor unit 106, a single thermostat 134 may be integrated into the indoor unit 106 in, for example, packaged HVAC systems. Additionally, other embodiments may include three or more thermostats 134.

The control system 132 determines the cooling or heating demand on the HVAC system 100 based on the user input, such as a desired temperature, desired temperature range, a desired humidity, and/or data from sensors within the thermostats 134 or sensors placed within the structure 102 and/or throughout the HVAC system 100. The data measured by the sensors may include, but is not limited to, the temperature within the climate-controlled area 112, the humidity within the climate-controlled area 112, the temperature outside of the structure 102, the humidity outside of the structure 102, and refrigerant pressure within the HVAC system. The HVAC system 100 may include any number of sensors and input devices, each of which can accept a user input.

Figure 2:
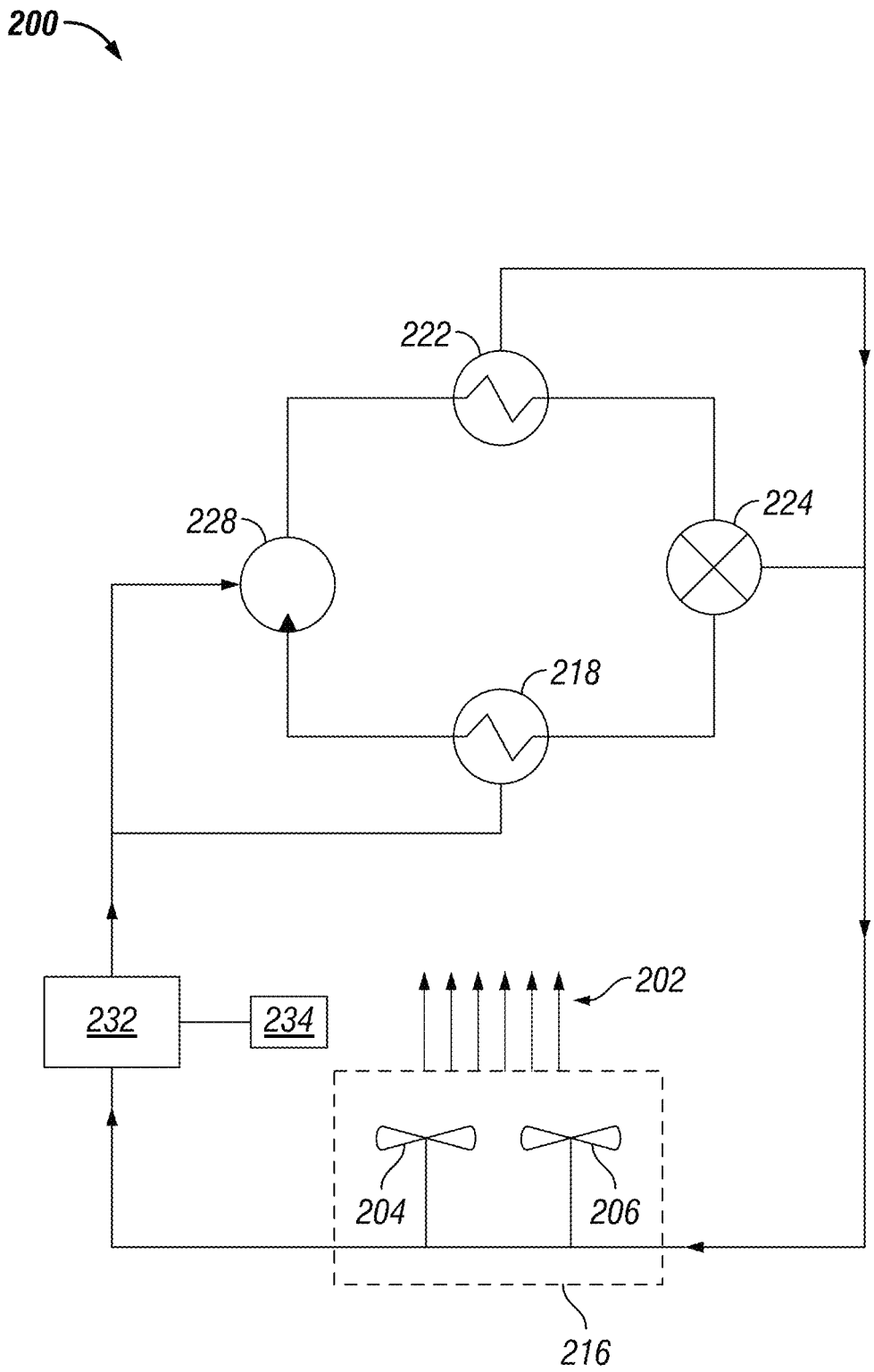
FIG. 2 is a simplified block diagram of an HVAC system 200, according to one or more embodiments.

Referring now to FIG. 2, FIG. 2 shows a block diagram of an HVAC system 200 in accordance with the present disclosure. The HVAC system 200 includes an outdoor heat exchanger 222, an expansion device 224, an indoor heat exchanger 218, and a compressor 228. Additionally, the heat exchangers 218, 222 may be either condensers or evaporators, depending on the configuration of the HVAC system 200 as operating in either cooling or heating modes if capable. A blower system 216 that includes two direct-drive blowers 204, 206, as described in more detail below, flows air 202 over the indoor heat exchanger 218 to provide a climate-controlled space with conditioned air. The HVAC system 200 may also include the equipment shown in FIG. 1 and function as discussed above with reference to FIG. 1. Accordingly, the function of the outdoor heat exchanger 222, the expansion device 224, the indoor heat exchanger 218, and the compressor 228 will not be discussed in detail except as necessary for the understanding of the HVAC system 200 shown in FIG. 2.

When cooling is desired, high-pressure, high-temperature vapor refrigerant flows from the compressor 228 to the outdoor heat exchanger 222, where the refrigerant is condensed into a high-pressure, medium-temperature liquid.

The high-pressure liquid refrigerant then flows to the expansion device 224, where the refrigerant is expanded to a low-pressure, low-temperature liquid refrigerant. The low-pressure, low-temperature liquid refrigerant is then evaporated in the indoor heat exchanger 218 into a low-pressure, low-temperature vapor refrigerant. The low-pressure, low-temperature vapor refrigerant then flows into the compressor 228 to begin the cycle again. When the HVAC system 200 is operating as a heat pump, the flow of refrigerant and the functions of the indoor and outdoor heat exchangers are reversed.

As shown in FIG. 2, the HVAC system 200 includes a control system 232 in electronic communication with the blowers 204, 206 of the blower system 216 and an input device 234, such as a thermostat. The input device 234 is configured to allow a user to select a desired temperature, a desired temperature range, a desired humidity, and/or any other climate setting. The control system 232 operates the blowers 204, 206 based on the demand on the HVAC system 200. Specifically, the control system 232 may operate only one of the blowers 204, 206 at a desired speed, operate both blowers 204, 206 at the same desired speed, or operate both blowers 204, 206 at different speeds based on the demand on the HVAC system 200. Further, although two blowers 204, 206 are shown in FIG. 2, the HVAC system 200 is not thereby limited. HVAC systems 200 may include two, three, four, or more blowers based on the expected demand on the HVAC system 200, the size of the climate-controlled space, dimensional constraints and other design considerations.

Figure 3:
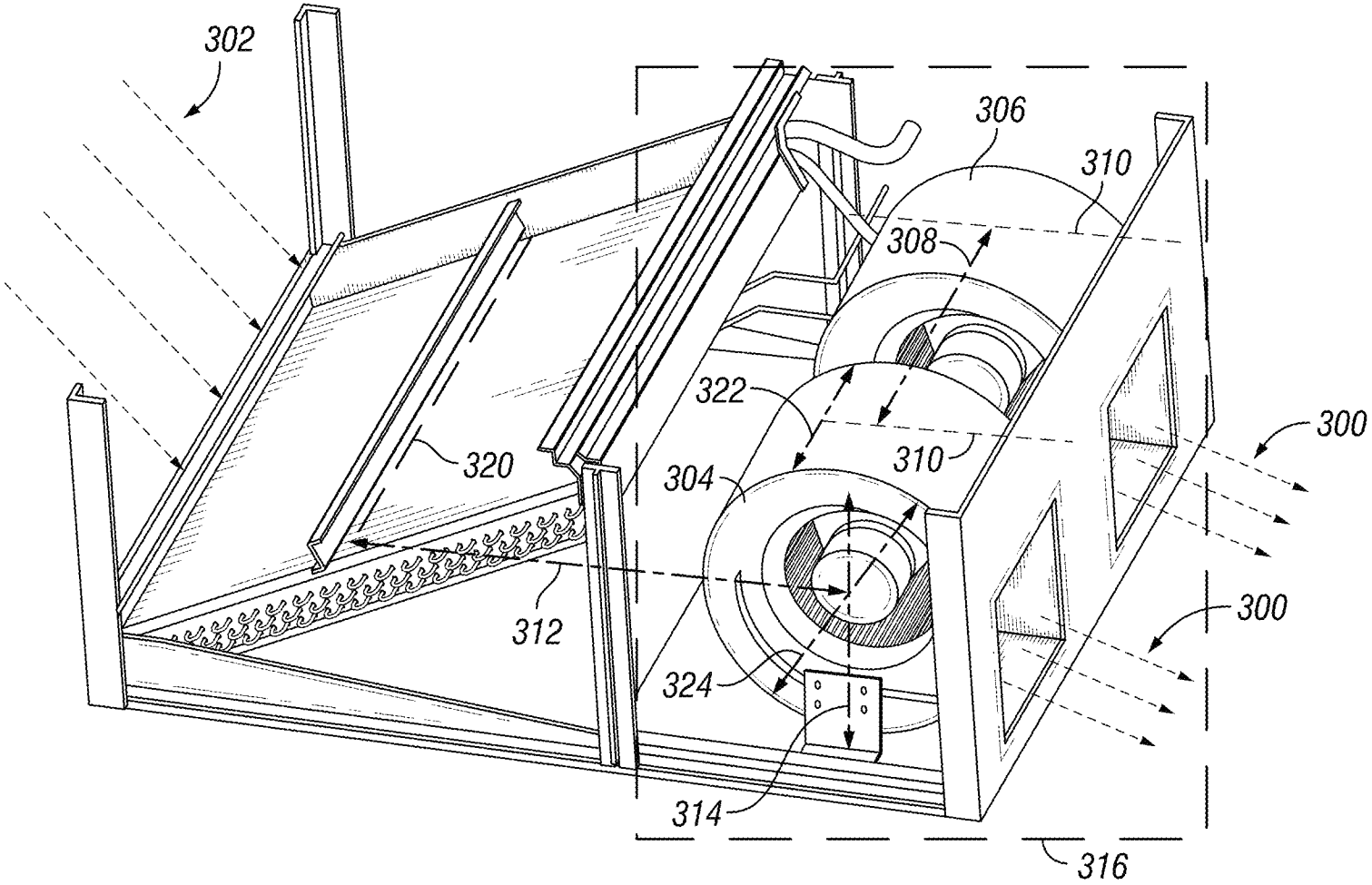
FIG. 3 is an isometric view of a blower system and indoor heat exchanger, according to one or more embodiments.

Turning now to FIG. 3, FIG. 3 is an isometric view of a blower system 316 and an indoor heat exchanger 318, according to one or more embodiments. As shown in FIG. 3, the blower system 316 includes two direct-drive blowers 304, 306 that flow air 302 over an indoor heat exchanger 318 to condition the air 300 output by the blower system 316. The blowers 304, 306 of the blower system 316 may be positioned in a draw-through configuration, as shown in FIG. 3, or be blow-through blowers. Although FIG. 3 depicts two blowers 304, 306 that have approximately the same maximum airflow rate, other embodiments may include three, four, or more blowers 304, 306 and/or one or more of the blowers 304, 306 may have a different airflow rate than the other blowers 304, 306. Additionally, one or more of the blowers may be a different type of a blower than the other blowers. As a non-limiting example, one blower 304, 306 may be a variable speed blower and another blower 304, 306 may be a fixed speed blower or a multispeed blower.

The blowers 304, 306 are optimally positioned relative to one another and/or the indoor heat exchanger 318 to improve the efficiency of the blower system 316. Additionally, the blowers 304, 306 are positioned relative to the indoor heat exchanger 318 independently of each other. As a non-limiting example of relative positions of the blowers 304, 306 and the indoor heat exchanger 318, a ratio of a distance 308 between midlines 310 of the widths of the blowers 304, 306 and a distance 312 between a central axis 314 of one or more of the blowers 304, 306 and a vertical midplane 320 of the indoor heat exchanger 318 may have a range of approximately 0.5 to approximately 4. As another example, a ratio of the distance 308 between the midlines 310 of the widths of the blowers 304, 306 and a width 322 of one or more blowers 304, 306 may have a range of approximately 0.5 to approximately 5.5. As another example, a ratio of the distance 308 between the midlines 310 of the widths of the blowers 304, 306 and a diameter 324 of one or more of the blowers 304, 306 may have a range of approximately 0.5 to approximately 4. These ratios may also be combined in any way to designate the relative positions of the blowers 304, 306 and the indoor heat exchanger 318. Further, positioning the blowers 304, 306 and the indoor heat exchanger 318 according to one or more of the above ratios increases the uniformity of airflow 302 over the indoor heat exchanger 318 and/or reduces interference with the air intake of one blower 304, 306 due to the other blower 304, 306.

Additionally, the indoor heat exchanger 318 may be positioned at an angle relative to a horizontal plane as shown in FIG. 3, or be perpendicular or parallel to a horizontal plane, depending on the design requirements of the HVAC system. Further, one blower 304, 306 may be positioned at a different distance 312 from the vertical midplane 320 indoor heat exchanger than the other blower 304, 306 or one blower 304, 306 may be positioned at an angle relative to the other blower 304, 306.

Figure 4:
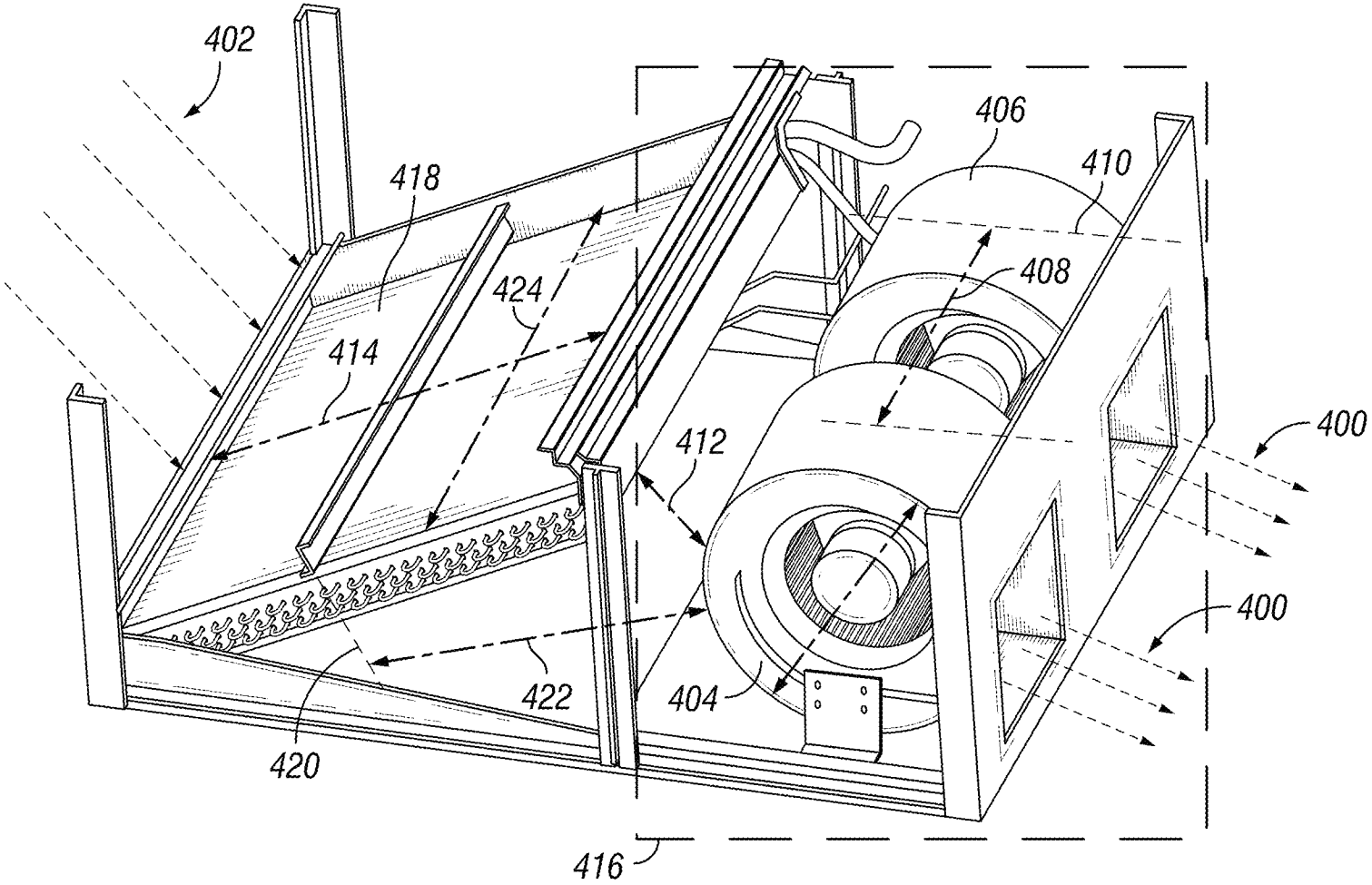
FIG. 4 is an isometric view of a blower system and indoor heat exchanger, according to one or more embodiments.

Turning now to FIG. 4, FIG. 4 is an isometric view of a blower system 416 and an indoor heat exchanger 418, according to one or more embodiments. As shown in FIG. 4, the blower system 416 includes two direct-drive blowers 404, 406 that flow air 402 over an indoor heat exchanger 418 to condition the air 400 output by the blower system 416. The blowers 404, 406 of the blower system 416 may be positioned in a draw-through configuration, as shown in FIG. 4, or be blow-through blowers. Although FIG. 4 depicts two blowers 404, 406 that have approximately the same rate, other embodiments may include three, four, or more blowers 404, 406 and/or one or more of the blowers 404, 406 may have a different airflow than the other blowers 404, 406. Additionally, one or more of the blowers may be a different type of blower than the other blowers. As a non-limiting example, one blower 404, 406 may be a variable speed blower and another blower 404, 406 may be a fixed speed blower or a multispeed blower.

The blowers 404, 406 are optimally positioned relative to one another and/or the indoor heat exchanger 418 to improve the efficiency of the blower system 416. Additionally, the blowers 404, 406 are positioned relative to the indoor heat exchanger 418 independently of each other. As a non-limiting example of relative positions of the blowers 404, 406 and the indoor heat exchanger 418, a ratio of a distance 412 between one or more of the blowers 404, 406 and the closest coil of the indoor heat exchanger 418 and a coil height 414 of the indoor heat exchanger 418 may have a range of approximately 0.1 to approximately 1. As another example, a ratio of the distance 412 between one or more of blower 404, 406 and the closest coil of the indoor heat exchanger 418 and a distance 422 between one or more of the blowers 404, 406 and a vertical midplane 420 of the indoor heat exchanger 418 may have a range of approximately 0.1 to approximately 1. As another example, a ratio of a ratio of a distance 408 between midlines 410 of the widths of the blowers 404, 406 and a coil width 424 of the indoor heat exchanger 418 may have a range of approximately 0.1 to approximately 1.

These ratios may also be combined in any way to designate the relative positions of the blowers 404, 406 and the indoor heat exchanger 418. Further, positioning the blowers 404, 406 and the indoor heat exchanger 418 according to one or more of the above ratios increases the uniformity or if desired, defines a proper predetermined distribution of airflow 402 over the indoor heat exchanger 418 and/or reduces interference with the air intake of one blower 404, 406 due to the other blower 404, 406, reducing airflow pulsations and undesired interference noise. Additionally, although the ratios above are described with reference to FIG. 3 or FIG.

4, the invention is not thereby limited. A single blower system may be configured using any combination of ratios described above.

Figure 5:
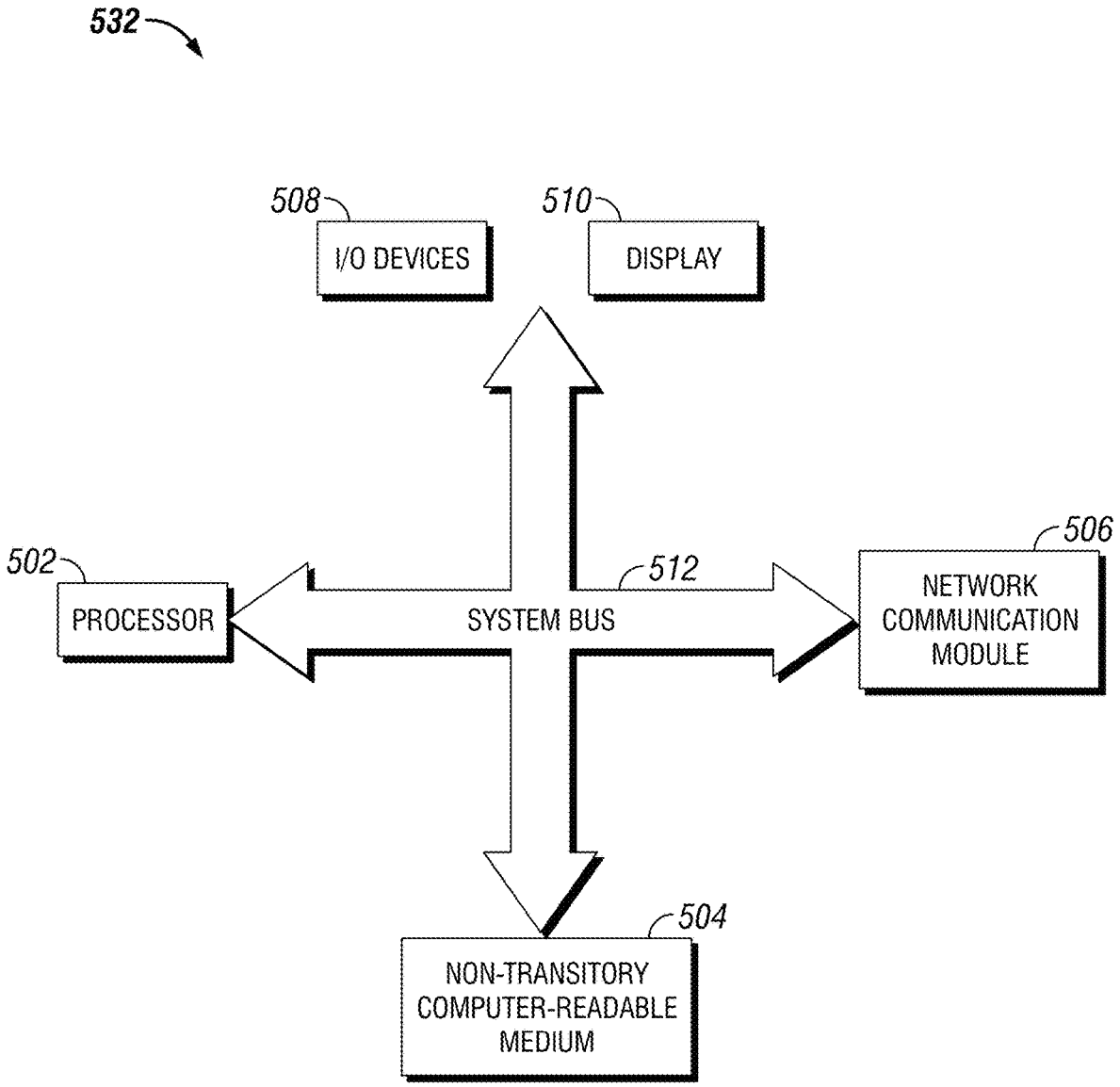
FIG. 5 is a block diagram of a controller, according to one or more embodiments.

FIG. 5 is a block diagram of a controller 532 that can be used to control blowers of an HVAC system, such as in the control systems 132, 232 described above. The controller 532 includes at least one processor 502, a non-transitory computer readable medium 504, an optional network communication module 506, optional input/output devices 508, and an optional display 510 all interconnected via a system bus 512. In at least one embodiment, the input/output device 508 and the display 510 may be combined into a single device, such as a touch-screen display. Further, the display 510 may also include a temperature sensor that monitors the temperature within the climate-controlled area. Software instructions executable by the processor 502 for implementing software instructions stored within the controller 532 in accordance with the illustrative embodiments described herein, may be stored in the non-transitory computer readable medium 504 or some other non-transitory computer-readable medium.

Although not explicitly shown in FIG. 5, it will be recognized that the controller 532 may be connected to one or more public and/or private networks via appropriate network connections, whether wired or wirelessly. It will also be recognized that software instructions may also be loaded into the non-transitory computer readable medium 504 from an appropriate storage media or via wired or wireless means.

Further examples include:

Example 1 is an HVAC system. The HVAC system includes a refrigeration circuit and a blower system. The refrigeration circuit includes a compressor, an outdoor heat exchanger, an expansion device, and an indoor heat exchanger. The blower system includes a first direct-drive blower and a second direct-drive blower. The first direct-drive blower flows air over the indoor heat exchanger. The second direct-drive blower flows air over the indoor heat exchanger and the second direct-drive blower is operable and positionable relative to the indoor heat exchanger independently from the first direct-drive blower.

In Example 2, the embodiments of any preceding paragraph or combination thereof further include wherein a maximum airflow rate of the first direct-drive blower is different than a maximum airflow rate of the second direct-drive blower.

In Example 3, the embodiments of any preceding paragraph or combination thereof further include wherein the first direct-drive blower, the second direct-drive blower, and the indoor heat exchanger are positioned such that a ratio of a distance between midlines of the widths of the first direct-drive blower and the second direct-drive blower and a distance between a central axis of either the first direct-drive blower or the second direct-drive blower and a vertical midplane of the indoor heat exchanger has a range of approximately 0.5 to approximately 4.

In Example 4, the embodiments of any preceding paragraph or combination thereof further include wherein the first direct-drive blower and the second direct-drive blower are positioned such that a ratio of a distance between midlines of the widths of the first direct-drive blower and the second direct-drive blower and a width of either the first direct-drive blower or the second direct-drive blower has a range of approximately 0.5 to approximately 5.5.

In Example 5, the embodiments of any preceding paragraph or combination thereof further include wherein the first direct-drive blower and the second direct-drive blower are positioned such that a ratio of a distance between midlines of the widths of the first direct-drive blower and the second direct-drive blower and a diameter of either the first direct-drive blower or the second direct-drive blower has a range of approximately 0.5 to approximately 4.

In Example 6, the embodiments of any preceding paragraph or combination thereof further include wherein the first direct-drive blower and the second direct-drive blower are positioned such that a ratio of a distance between either the first direct-drive blower or the second direct-drive blower and a closest coil of the indoor heat exchanger and a coil height of the indoor heat exchanger has a range of approximately 0.1 to approximately 1.

In Example 7, the embodiments of any preceding paragraph or combination thereof further include wherein the first direct-drive blower and the second direct-drive blower are positioned such that a ratio of a distance between either the first direct-drive blower or the second direct-drive blower and a closest coil of the indoor heat exchanger and a distance between either the first direct-drive blower or the second direct-drive blower and a vertical midplane of the indoor heat exchanger has a range of approximately 0.1 to approximately 1.

In Example 8, the embodiments of any preceding paragraph or combination thereof further include wherein the first direct-drive blower and the second direct-drive blower are positioned such that a ratio of a distance between midlines of the widths of the first direct-drive blower and the second direct-drive blower and a coil width of the indoor heat exchanger has a range of approximately 0.1 to approximately 1.

In Example 9, the embodiments of any preceding paragraph or combination thereof further include a control system programmed to control the blower system based on a demand on the HVAC system.

In Example 10, the embodiments of any preceding paragraph or combination thereof further include wherein the control system is further programmed to operate the first direct-drive blower and the second direct-drive blower independently based on the demand on the HVAC system.

In Example 11, the embodiments of any preceding paragraph or combination thereof further include wherein the control system is further programmed to be able to operate the first direct-drive blower at a different speed than the second direct-drive blower based on the demand on the HVAC system.

Example 12 is a blower system for an HVAC system including an indoor heat exchanger. The blower system includes a first direct-drive blower that is operable to flow air over the indoor heat exchanger. The blower system also includes a second direct-drive blower that is operable to flow air over the indoor heat exchanger and that is operable and positionable relative to the indoor heat exchanger independently from the first direct-drive blower.

In Example 13, the embodiments of any preceding paragraph or combination thereof further include wherein a maximum airflow rate of the first direct-drive blower is different than a maximum airflow rate of the second direct-drive blower.

In Example 14, the embodiments of any preceding paragraph or combination thereof further include wherein the first direct-drive blower and the second direct-drive blower are positioned such that a ratio of a distance between midlines of the widths of the first direct-drive blower and the second direct-drive blower and a width of either the first direct-drive blower or the second direct-drive blower has a range of approximately 0.5 to approximately 5.5.

In Example 15, the embodiments of any preceding paragraph or combination thereof further include wherein the first direct-drive blower and the second direct-drive blower are positioned such that a ratio of a distance between midlines of the widths of the first direct-drive blower and the second direct-drive blower and a diameter of either the first direct-drive blower or the second direct-drive blower has a range of approximately 0.5 to approximately 4.

In Example 16, the embodiments of any preceding paragraph or combination thereof further include a control system programmed to control the blower system based on a demand on the HVAC system.

In Example 17, the embodiments of any preceding paragraph or combination thereof further include wherein the control system is further programmed to operate the first direct-drive blower and the second direct-drive blower independently based on the demand on the HVAC system.

In Example 18, the embodiments of any preceding paragraph or combination thereof further include wherein the control system is further programmed to be able to operate the first direct-drive blower at a different speed than the second direct-drive blower based on the demand on the HVAC system.

In Example 19, the embodiments of any preceding paragraph or combination thereof further include wherein the first direct-drive blower and the second direct-drive blower are positioned in a draw-through configuration.

In Example 20, the embodiments of any preceding paragraph or combination thereof further include wherein the first direct-drive blower and the second direct-drive blower are positioned in a blow-through configuration.

In Example 21, the embodiments of any preceding paragraph or combination thereof further include wherein the first blower is one of a multi-speed blower, a variable speed blower, or a fixed speed blower and the second blower is a different one of a multi-speed blower, a variable speed blower, or a fixed speed blower than the first blower.

Example 22 is a method of operating an HVAC system. The method includes identifying an input temperature for a room. The method also includes measuring a temperature of the room. The method further includes determining a demand on the HVAC system based on the input temperature and the measured temperature of the room. The method also includes operating one or both of a first direct-drive blower of the HVAC system and a second direct-drive blower of the HVAC system independently to flow air over an indoor heat exchanger of the HVAC system based on the demand on the HVAC system.

In Example 23, the embodiments of any preceding paragraph or combination thereof further include positioning the first direct-drive blower and the second direct-drive blower relative to the indoor heat exchanger and independently of each other.

In Example 24, the embodiments of any preceding paragraph or combination thereof further include positioning the first direct-drive blower, the second direct-drive blower, and an indoor heat exchanger of the HVAC system such that a ratio of a distance between midlines of the widths of the first direct-drive blower and the second direct-drive blower and a distance between a central axis of either the first direct-drive blower or the second direct-drive blower and a vertical midplane of the indoor heat exchanger has a range of approximately 0.5 to approximately 4.

In Example 25, the embodiments of any preceding paragraph or combination thereof further include positioning the first direct-drive blower and the second direct-drive blower such that a ratio of a distance between midlines of the widths of the first direct-drive blower and the second direct-drive blower and a width of either the first direct-drive blower or the second direct-drive blower has a range of approximately 0.5 to approximately 5.5.

In Example 26, the embodiments of any preceding paragraph or combination thereof further include positioning the first direct-drive blower and the second direct-drive blower such that a ratio of a distance between midlines of the widths of the first direct-drive blower and the second direct-drive blower and a diameter of either the first direct-drive blower or the second direct-drive blower has a range of approximately 0.5 to approximately 4.

In Example 27, the embodiments of any preceding paragraph or combination thereof further include wherein a maximum airflow rate of the first direct-drive blower is different than a maximum airflow rate of the second direct-drive blower.

For the embodiments and examples above, a non-transitory computer readable medium can comprise instructions stored thereon, which, when performed by a machine, cause the machine to perform operations, the operations comprising one or more features similar or identical to features of methods and techniques described above. The physical structures of such instructions may be operated on by one or more processors. A system to implement the described algorithm may also include an electronic apparatus and a communications unit. The system may also include a bus, where the bus provides electrical conductivity among the components of the system. The bus can include an address bus, a data bus, and a control bus, each independently configured. The bus can also use common conductive lines for providing one or more of address, data, or control, the use of which can be regulated by the one or more processors. The bus can be configured such that the components of the system can be distributed. The bus may also be arranged as part of a communication network allowing communication with control sites situated remotely from system.

In various embodiments of the system, peripheral devices such as displays, additional storage memory, and/or other control devices that may operate in conjunction with the one or more processors and/or the memory modules. The peripheral devices can be arranged to operate in conjunction with display unit(s) with instructions stored in the memory module to implement the user interface to manage the display of the anomalies. Such a user interface can be operated in conjunction with the communications unit and the bus. Various components of the system can be integrated such that processing identical to or similar to the processing schemes discussed with respect to various embodiments herein can be performed. Similarly, the term electronic communication may include wired or wireless communication either directly between components and/or systems or through one or more intermediate components and/or systems.

As used herein, a range is intended to include the upper and lower limits of the range; e.g., a range from 50 to 150 includes both 50 and 150. Additionally, the term "approximately" includes all values within 5% of the target value; e.g., approximately 100 includes all values from 95 to 105, including 95 and 105. Further, approximately between includes all values within 5% of the target value for both the upper and lower limits; e.g., approximately between 50 and 150 includes all values from 47.5 to 157.5, including 47.5 and 157.5.

In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

Reference throughout this specification to "one embodiment," "an embodiment," "embodiments," "some embodiments," "certain embodiments," or similar language means that a particular feature, structure, or characteristic described in connection with the embodiment may be included in at least one embodiment of the present disclosure. Thus, these phrases or similar language throughout this specification may, but do not necessarily, all refer to the same embodiment.

The embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

What is claimed is:

1. A method of operating an HVAC system, the method comprising:

identifying an input temperature for a room;

measuring a temperature of the room;

determining a demand on the HVAC system based on the input temperature and the measured temperature of the room; and operating one or both of a first direct-drive blower of the HVAC system and a second direct-drive blower of the HVAC system independently to flow air over an indoor heat exchanger of the HVAC system based on the demand on the HVAC system; and positioning the first direct-drive blower, the second direct-drive blower, and an indoor heat exchanger of the HVAC system such that a ratio of a distance between midlines of widths of the first direct-drive blower and the second direct-drive blower and a distance between a central axis of either the first direct-drive blower or the second direct-drive blower and a vertical midplane of the indoor heat exchanger has a range of approximately 0.5 to approximately 4.

2. The method of claim 1, further comprising positioning the first direct-drive blower and the second direct-drive blower relative to the indoor heat exchanger and independently of each other.

3. The method of claim 1, further comprising positioning the first direct-drive blower and the second direct-drive blower such that a ratio of a distance between midlines of widths of the first direct-drive blower and the second direct-drive blower and a width of either the first direct-drive blower or the second direct-drive blower has a range of approximately 0.5 to approximately 5.5.

4. The method of claim 1, further comprising positioning the first direct-drive blower and the second direct-drive blower such that a ratio of a distance between midlines of widths of the first direct-drive blower and the second direct-drive blower and a diameter of either the first direct-drive blower or the second direct-drive blower has a range of approximately 0.5 to approximately 4.

5. The method of claim 1, wherein a maximum airflow rate of the first direct-drive blower is different than a maximum airflow rate of the second direct-drive blower.

6. The method of claim 1, further comprising positioning the first direct-drive blower independently of the second direct-drive blower.

7. The method of claim 1, wherein positioning the first direct-drive blower independently of the second direct-drive blower comprises positioning the first direct-drive blower and the second direct-drive blower such that the first direct-drive blower and the second direct-drive blower are at least one of positioned within a specified range of distances with respect to the indoor heat exchanger or with respect to each other.

8. A method of operating an HVAC system, the method comprising:

identifying an input temperature for a room;

measuring a temperature of the room;

determining a demand on the HVAC system based on the input temperature and the measured temperature of the room;

operating one or both of a first direct-drive blower of the HVAC system and a second direct-drive blower of the HVAC system independently to flow air over an indoor heat exchanger of the HVAC system based on the demand on the HVAC system; and positioning the first direct-drive blower and the second direct-drive blower such that a ratio of a distance between midlines of widths of the first direct-drive blower and the second direct-drive blower and a width of either the first direct-drive blower or the second direct-drive blower has a range of approximately 0.5 to approximately 5.5.

9. The method of claim 8, further comprising positioning the first direct-drive blower and the second direct-drive blower relative to the indoor heat exchanger and independently of each other.

10. The method of claim 8, further comprising positioning the first direct-drive blower, the second direct-drive blower, and an indoor heat exchanger of the HVAC system such that a ratio of a distance between midlines of widths of the first direct-drive blower and the second direct-drive blower and a distance between a central axis of either the first direct-drive blower or the second direct-drive blower and a vertical midplane of the indoor heat exchanger has a range of approximately 0.5 to approximately 4.

11. The method of claim 8, further comprising positioning the first direct-drive blower and the second direct-drive blower such that a ratio of a distance between midlines of widths of the first direct-drive blower and the second direct-drive blower and a diameter of either the first direct-drive blower or the second direct-drive blower has a range of approximately 0.5 to approximately 4.

12. The method of claim 8, wherein a maximum airflow rate of the first direct-drive blower is different than a maximum airflow rate of the second direct-drive blower.

13. The method of claim 1, further comprising positioning the first direct-drive blower independently of the second direct-drive blower.

14. The method of claim 8, wherein positioning the first direct-drive blower independently of the second direct-drive blower comprises positioning the first direct-drive blower and the second direct-drive blower such that the first direct-drive blower and the second direct-drive blower are at least one of positioned within a specified range of distances with respect to the indoor heat exchanger or with respect to each other.

15. A method of operating an HVAC system, the method comprising:

identifying an input temperature for a room;

measuring a temperature of the room;

determining a demand on the HVAC system based on the input temperature and the measured temperature of the room;

operating one or both of a first direct-drive blower of the HVAC system and a second direct-drive blower of the HVAC system independently to flow air over an indoor heat exchanger of the HVAC system based on the demand on the HVAC system; and positioning the first direct-drive blower and the second direct-drive blower such that a ratio of a distance between midlines of widths of the first direct-drive blower and the second direct-drive blower and a diameter of either the first direct-drive blower or the second direct-drive blower has a range of approximately 0.5 to approximately 4.

16. The method of claim 15, further comprising positioning the first direct-drive blower and the second direct-drive blower relative to the indoor heat exchanger and independently of each other.

17. The method of claim 15, further comprising positioning the first direct-drive blower, the second direct-drive blower, and an indoor heat exchanger of the HVAC system such that a ratio of a distance between midlines of widths of the first direct-drive blower and the second direct-drive blower and a distance between a central axis of either the first direct-drive blower or the second direct-drive blower and a vertical midplane of the indoor heat exchanger has a range of approximately 0.5 to approximately 4.

18. The method of claim 15, further comprising positioning the first direct-drive blower and the second direct-drive blower such that a ratio of a distance between midlines of widths of the first direct-drive blower and the second direct-drive blower and a width of either the first direct-drive blower or the second direct-drive blower has a range of approximately 0.5 to approximately 5.5.

19. The method of claim 15, wherein a maximum airflow rate of the first direct-drive blower is different than a maximum airflow rate of the second direct-drive blower.

20. The method of claim 15, wherein positioning the first direct-drive blower independently of the second direct-drive blower comprises positioning the first direct-drive blower and the second direct-drive blower such that the first direct-drive blower and the second direct-drive blower are at least one of positioned within a specified range of distances with respect to the indoor heat exchanger or with respect to each other.

* * * * *